US005119601A

United States Patent [19]

Yamashita et al.

[11] Patent Number: 5,119,601

[45] Date of Patent: Jun. 9, 1992

[54] APPARATUS FOR ABRADING A SURFACE

[75] Inventors: Teruaki Yamashita; Hirokazu Naka, both of Shizuoka, Japan

[73] Assignee: Yamaha Motor Co., Ltd., Shizuoka, Japan

[21] Appl. No.: 650,996

[22] Filed: Feb. 4, 1991

Related U.S. Application Data

[63] Continuation of Ser. No. 372,553, Jun. 28, 1989, abandoned.

[30] Foreign Application Priority Data

Sep. 9, 1988 [JP] Japan ..... 63-224790
Nov. 29, 1988 [JP] Japan ..... 63-299522

[51] Int. Cl.[5] ..... B24B 7/02
[52] U.S. Cl. ..... 51/334; 51/335
[58] Field of Search ..... 51/334-337, 51/181 R, 181 SF

[56] References Cited

U.S. PATENT DOCUMENTS 564,587 7/1896 Black ..... 51/335
1,964,295 6/1934 Miller ..... 51/336 X
2,198,047 12/1939 Wick ..... 51/335
2,259,475 10/1941 Koether ..... 51/337
2,413,165 12/1946 Bonkowski ..... 51/337
2,599,961 6/1952 White ..... 51/337
2,826,776 3/1958 Peterson ..... 51/336 X
3,058,269 10/1962 Block ..... 51/337
3,772,883 11/1973 Belanger ..... 51/337
3,890,746 6/1975 Saegusa ..... 51/334

FOREIGN PATENT DOCUMENTS 0424697 10/1974 U.S.S.R. ..... 51/148

*Primary Examiner*—M. Rachuba
*Attorney, Agent, or Firm*—Bacon & Thomas

[57] ABSTRACT

An apparatus for abrading a curved surface includes a rotary wheel provided with a plurality of pins and a corresponding number of flexible members, wherein an endless sandpaper band is slidably wound about each pair of corresponding pins and flexible members. As the wheel rotates, the sandpaper bands abrade the workpiece in such a manner that each sandpaper band slides about its supporting pin and flexible member, thus presenting an ever-changing abrading surface to the workpiece. In a second embodiment, a plurality of rotary shafts are substituted for the pins, and driven through the same driving source as drives the rotary wheel so that a positive rotation is provided the sandpaper bands during the abrading process.

7 Claims, 5 Drawing Sheets

APPARATUS FOR ABRADING A SURFACE

This application is a continuation, of application Ser. No. 372,553, filed Jun. 28, 1989 now abandoned.

BACKGROUND OF THE INVENTION

1. Field of the Invention

This invention relates to an abrasion device suitable for abrading a surface of a workpiece.

2. Description of the Related Art

For abrading surfaces of a workpiece, and especially curved surfaces such as found on a propeller for marine vessels, a flap wheel comprising a pulley and a plurality of sandpaper or abrasive cloth bands supported on and radially outwardly extending about the periphery of the pulley has generally been used. In such an abrasion device, by rotation of the flap wheel, the sandpaper abrasive bands are brought into moving contact with the curved surfaces of the workpiece to effect abrasion finishing or shaping of same.

Since only the tip portions of the sandpaper bands are brought into contact with the surface to be treated, these portions soon wear over time, so that the effective diameter of the flap wheel is gradually reduced. Thus, it becomes necessary to control the distance between the flap wheel and the workpiece as the effective diameter changes.

Further, as the end portions of the sandpaper bands wear, the bands must be replaced frequently even through the remainder of each band is still usable. This is not only economically disadvantageous but also lowers work efficiency.

SUMMARY OF THE INVENTION

The present invention does not require relative workpiece position adjustment, and abrades a workpiece with a higher degree of precision over an extended period of time, thus improving work efficiency.

The present abrasion device includes a rotary wheel, a plurality of flexible plate-like members radially outwardly extending about the periphery of the rotary wheel, and an endless sandpaper or abrasive cloth band slidably wound around each of the plate-like members.

When the rotary wheel is rotated, the plate-like members and the sandpaper bands also rotate about the wheel axis to abrade the workpiece. The friction that results when the sandpaper bands contact the surface of the work forces the bands to slide about the plate-like members. As a result, that portion of each of the sandpaper bands that contacts the work is always renewed, so that the entire surface of each sandpaper band is used. The abrasion device thus performs efficiently for a longer period of time than did those of the prior art, since the sandpaper bands have a longer service time. Further, since the sandpaper bands are free from localized abrasion of the tip portions, the relative position with respect to the workpiece remains unchanged throughout the abrading operation so that position adjustment is not required. An additional advantage is that, since each sandpaper band is supported by a flexible plate-like member, the band can deform so as to follow curved surfaces of the work, ensuring precise abrasion.

DETAILED DESCRIPTION OF THE PREFERRED EMBODIMENTS

Figure 1:
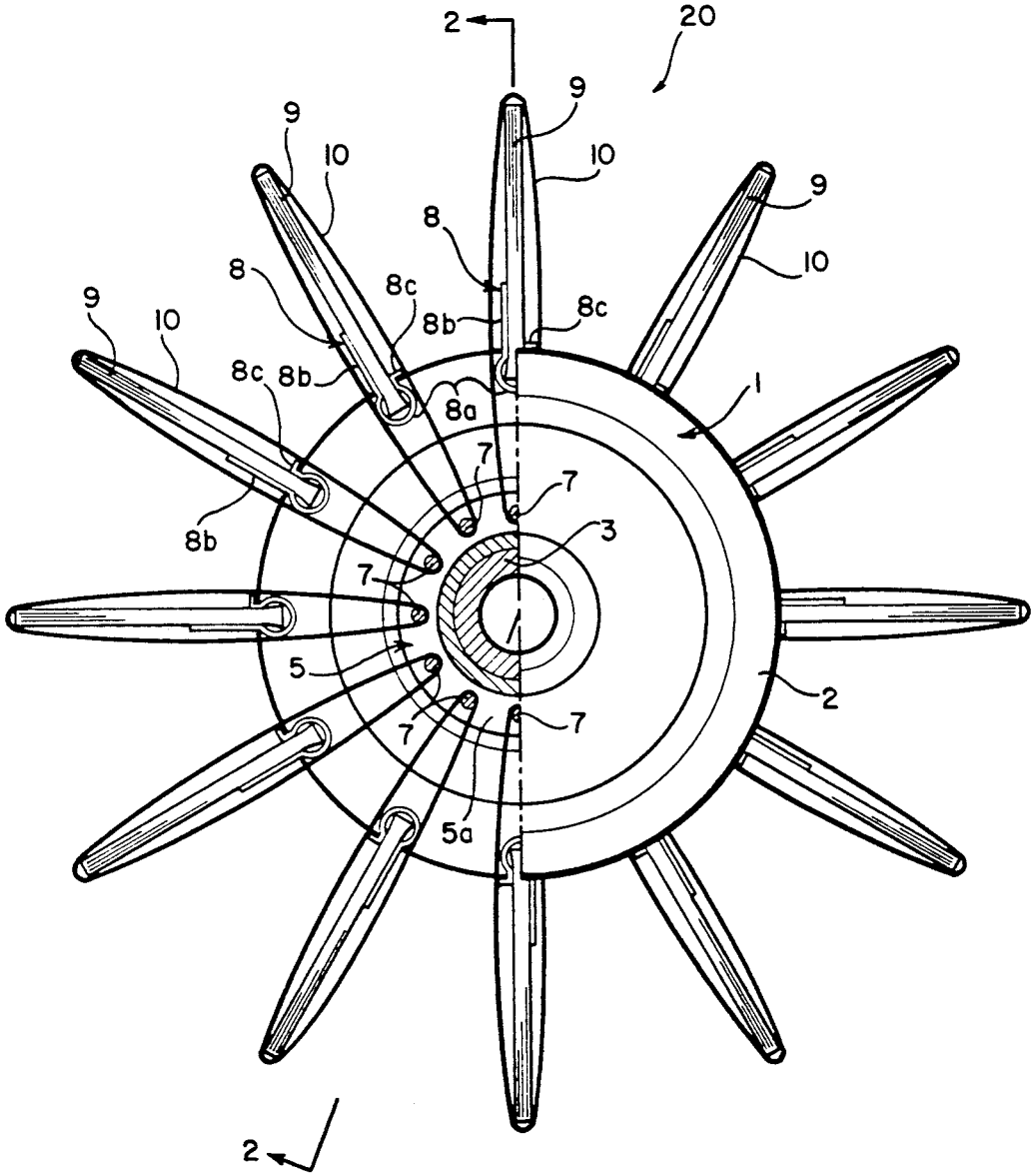
FIG. 1 is a front view, in partial cross-section, showing one embodiment of an abrasion device constructed according to the teachings of the present invention.
Figure 2:
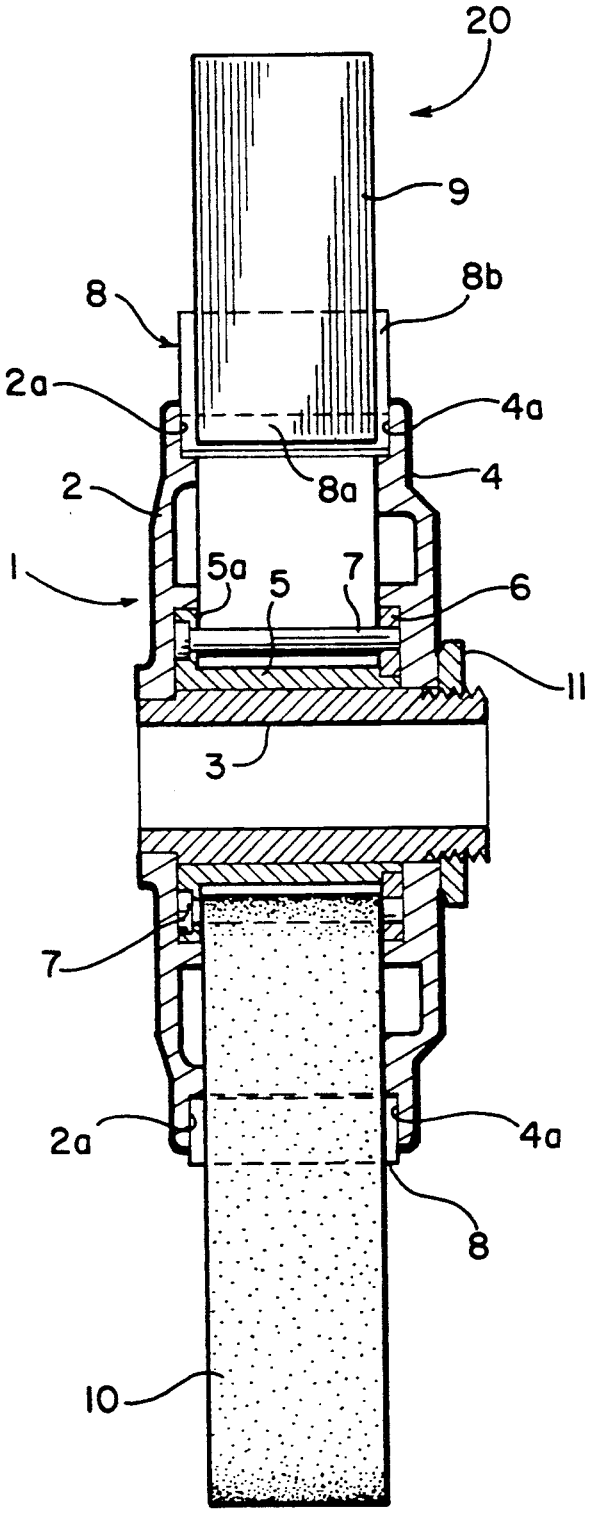
FIG. 2 is a cross-section taken on line II—II in FIG. 1.

Referring to FIGS. 1 and 2, reference numeral 20 denotes an abrasion device including circular wheel 1, which comprises disk-like base plate 2, hollow arbor shaft 3 perpendicularly inserted into and fixedly connected to the center of base plate 2, and intermediate plate 4, which is similar to base plate 2 and has a center opening into which shaft 3 is inserted. Between plates 2 and 4, a substantially tubular sleeve 5 surrounds the outer periphery of the shaft 3. Sleeve 5 includes a flange 5*a* at one end, and a groove in the periphery of the other end with which a holder support 6 of a ring-like shape is supportingly engaged. Between flange 5*a* and holder support 6 are disposed a plurality (12 in the illustrated embodiment) of holder pins 7 in parallel with shaft 3.

Plates 2 and 4 include circumferentially equally-spaced engaging grooves 2*a* and 4*a*, corresponding in number to the number of holder pins 7, at radially opposing portions of the wheel periphery. A like plurality of radially and laterally extending reinforcement members 8 each comprising a single bent sheet-like member are supported on the outer periphery of wheel 1. More particularly, each reinforcement member 8 has a rounded end 8*a* the sides of which engage one pair of the opposing grooves 2*a* and 4*a*, a flatwall portion 8*b* and a circumferential tab portion 8*c*.

As shown in FIG. 1, each reinforcement member 8 and its corresponding holder pin 7 are located on the same line radially extending from the axis of wheel 1. A base portion of a flexible plate-like member 9, which preferably comprises a wire brush, is fitted into each reinforcement member 8 which reinforces an inner radial length of the wire brush. Thus, a plurality (12 in the illustrated embodiment) of wire brushes 9 are mounted on the outer periphery of wheel 1 and extend radially outwardly from its axis.

Around each of the holder pins 7 and the corresponding wire brushes 9, an endless sandpaper or abrasive cloth band 10 is slidably supported so as to cover the wire brush 9.

The abrasion device 20 may be assembled in the following manner. To the shaft 3 fixed to the base plate 2, are successively mounted sleeve 5, holder support 6, holder pins 7, reinforcement members 8, wire brushes 9 and sandpaper bands 10. After inserting the intermediate plate 4 on the shaft 3, a nut 11 threadeadly engaged with the end portion of the shaft 3 is tightened to complete a unitary structure. In disassembling the abrasion device 20, such as for exchanging the sandpaper bands 10, the nut 11 is loosened to detach the intermediate plate 4 from the shaft 3.

Figure 3:
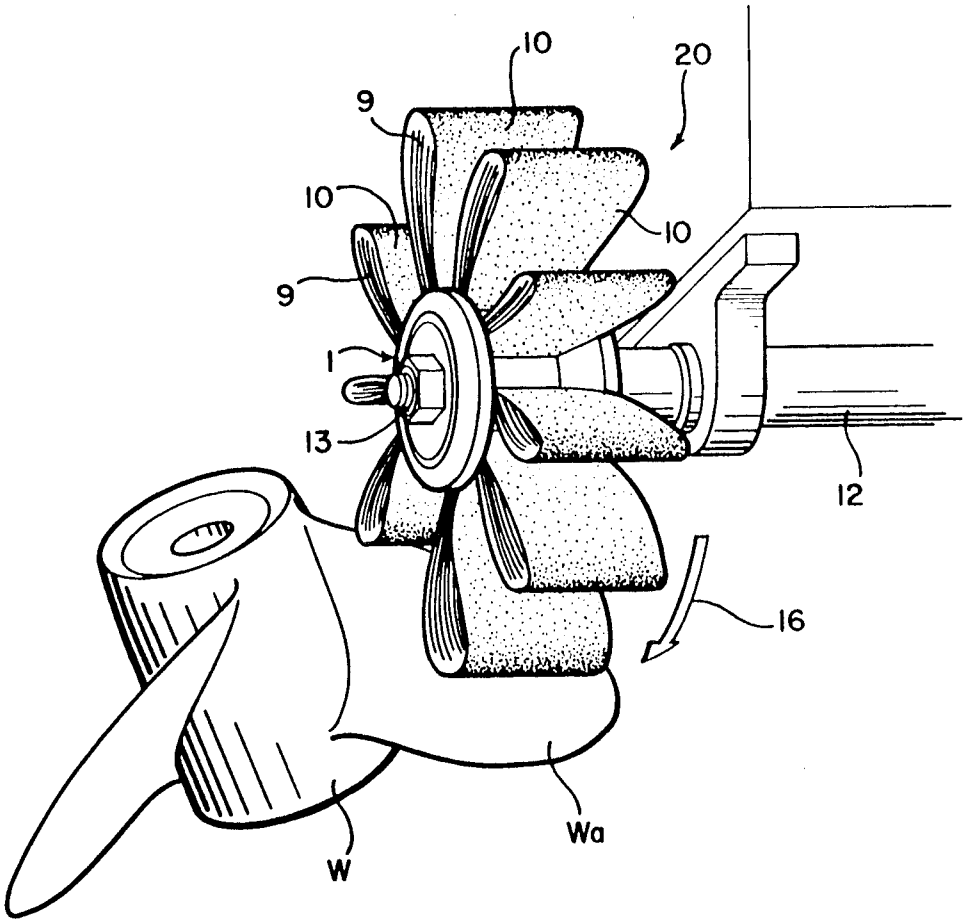
FIGS. 3 and 4 are perspective and partial side views, respectively, showing the operation of the working device.
Figure 4:
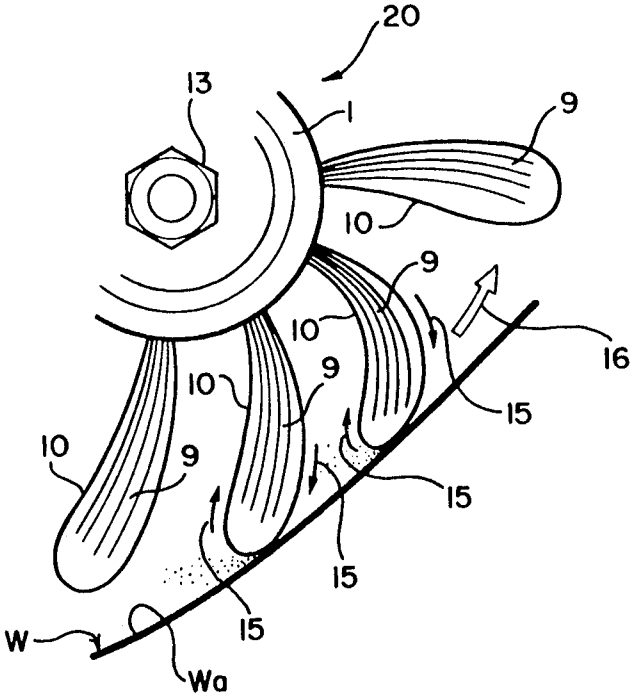

The function of the abrasion device 20 will now be described with reference to FIGS. 3 and 4. In use, the abrasion device 20 is attached to a drive shaft 12 by nuts 13 as illustrated in FIG. 3. When the drive shaft 12 is rotated by a drive means (not shown), the abrasion device 20 is also rotated therewith to abrade a work surface Wa of a workpiece W, for example a propeller for a marine vessel, as shown in FIG. 3.

More particularly, when the wheel 1 of the abrasion device 20 is rotated in the direction shown by arrow 16 (i.e., counterclockwise) the wire brushes 9 and the sandpaper bands 10 are rotated in the same direction to abrasion finish or shape the surface Wa. In this case, as each sandpaper band 10 is brought into contact with the surface Wa, it also slides around its wire brush 9 in the direction shown by arrows 15 (i.e., clockwise) in FIG. 4 due to the pressure of and friction force from contacting surface Wa.

Therefore, the operating surface of the sandpaper band 10 is successively changed so that the entire surface of the sandpaper band is effectively used. The abrasion device can thus exhibit high performance for a long period of time, since the sandpaper bands have a longer service time. Too, the frequency in exchanging worn bands with new ones is substantially reduced, with working efficiency thereby improved.

Since sandpaper bands 10 are free from localized abrasion of the tip portions, which is unavoidable when using the conventional flap wheel, their relative positions with respect to surface Wa remain unchanged throughout the working operation so that a high precision treatment can be effected.

Furthermore, since each of the sandpaper bands 10 is supported and backed by a flexible wire brush 9, the sandpaper band 10 can deform so as to follow curved surfaces Wa of workpiece W, ensuring precise abrasion work.

Figure 5:
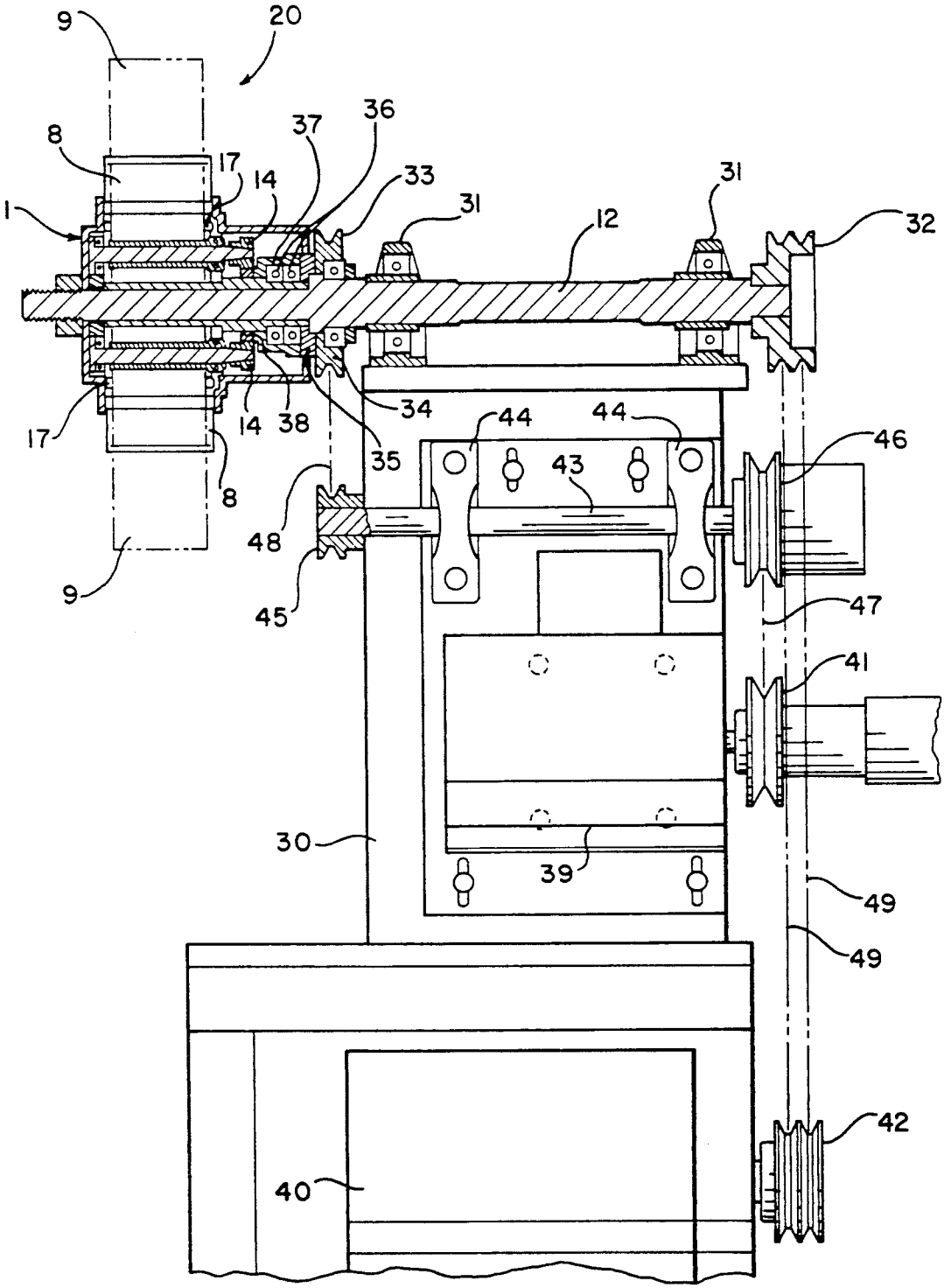
FIG. 5 is a side view, partly in cross-section, diagrammatically showing an abrasion device of a second embodiment of the invention.
Figure 6:
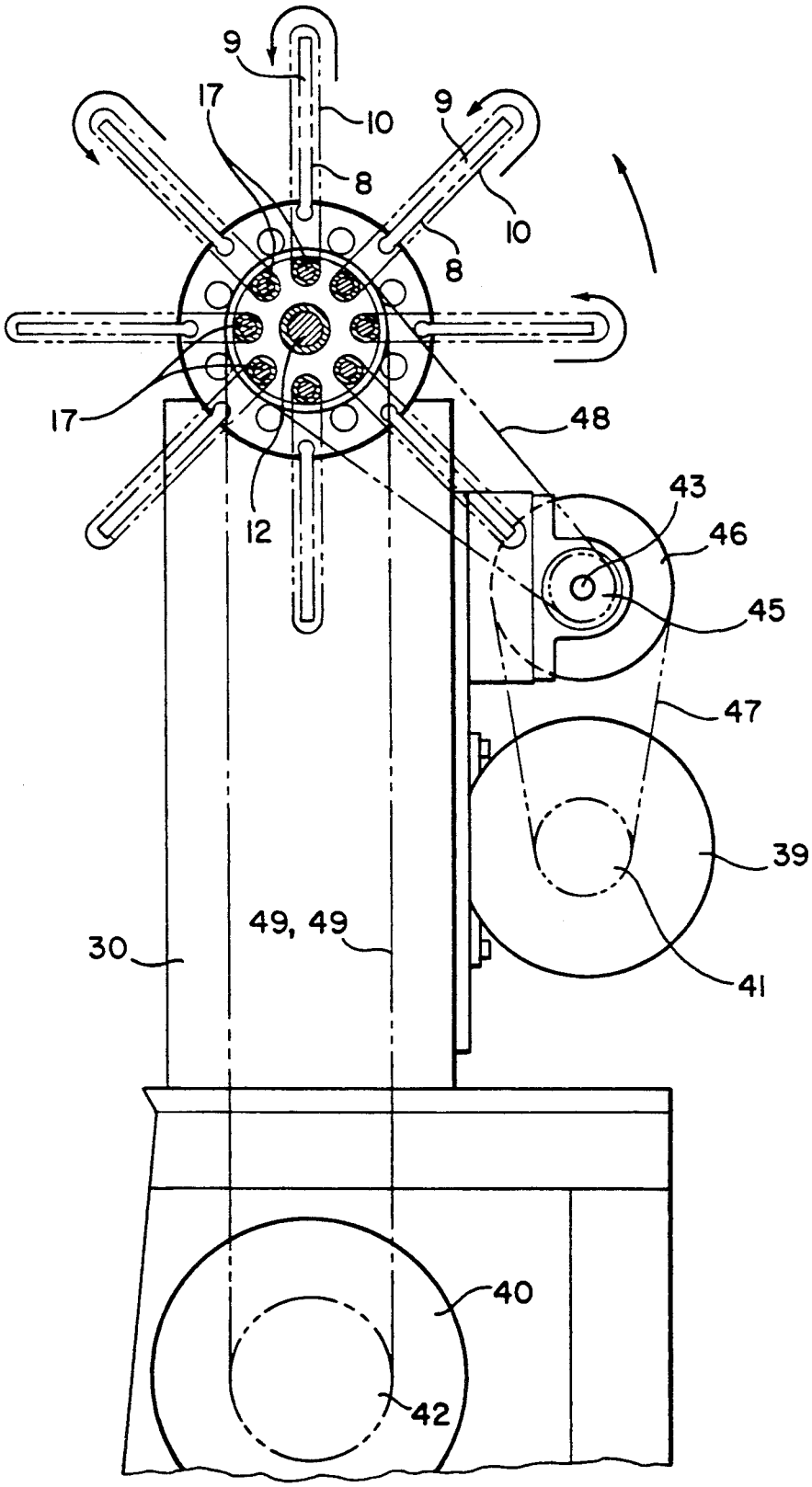
FIG. 6 is a front view, partly in cross-section, of the abrasion device of FIG. 5.

FIGS. 5 and 6 illustrate another embodiment according to the present invention. FIG. 5 is a side view, partly in cross-section, diagrammatically showing the abrasion device, and FIG. 6 is a front view, partly in cross-section, of the abrasion device of FIG. 5. In these Figures, the same reference numerals designate similar component parts of the first embodiment described above. Description of such parts is not repeated here.

The abrasion device 20 in this embodiment is mounted on an overhanging end portion of drive shaft 12 which is journaled between pillow blocks 31 provided on frame 30. Pulley 32 is secured to the other end of the drive shaft 12.

The abrasion device 20 has a wheel 1 in which a plurality (8 in the illustrated case) of rotary shafts 17 are accommodated. In this embodiment, an endless sandpaper band 10 is wound around the periphery of each rotary shaft 17, rather than around a stationary pin 7, as in the FIG. 1 embodiment. Each of the rotary shafts 17 has an end portion (right end portion in FIG. 5) provided with a planetary gear 14 of a small diameter.

On the middle portion of the drive shaft 12 is rotatably supported a V-pulley 33 through a ball bearing 34. The pulley 33 is engaged by a ring-like connecting plate 35, which is rotatably supported about the drive shaft 12. To the connecting plate 35 is fixed an end portion of a housing 37 accommodating two ball bearings 36 secured to the drive shaft 12. The housing 37 has the other end portion connected to a sun gear, which in turn is rotatably supported about the drive shaft 12. The sun gear 38 is in meshing engagement with the above-mentioned planetary gears 14.

Two upper and lower motors 39 and 40 mounted on frame 30 have their output shafts secured to change pulley 41 and V-pulley 42, respectively. Rotating shaft 43 is disposed above the motor 39 and rotatably supported by pillow blocks 44. Rotating shaft 43 is provided with V-pulley 45 and change pulley 46 at its ends. V-belt 47 extends between the change pulleys 41 and 46. V-belt 48 extends between V-pulleys 33 and 45. V-belts 49 extend between V-pulleys 32 and 42.

Upon actuation of motor 40, drive force is transmitted through V-pulley 42, V-belts 49 and V-pulley 32 to the drive shaft 12 so that the abrasion device 20 is rotatingly driven. On the other hand, the drive force of motor 39 is transmitted to sun gear 38 through change pulley 41, V-belt 47, change pulley 46, rotating shaft 43, V-pulley 45, V-belt 48, V-pulley 33, connecting plate 35 and housing 37 so that the sun gear 38 is rotated. The rotation of sun gear 38 causes planetary gears 14 and rotary shafts 17 to rotate. As a result, each of the rotary shafts 17 revolves about the drive shaft 12 while rotating on its own axis.

When the abrasion device 20 is rotated as above, and wheel 1 is rotated in the direction shown in FIG. 6, each sandpaper band 10 is pressed to its corresponding rotary shaft 17 by centrifugal force. Since the rotary shafts 17 rotate while revolving, each of the sandpaper bands 10 is forced to move in the directions shown by the arrows in FIG. 6, that is, in the same sense of rotation as wheel 1. Thus, when abrading under the above conditions, both a pressing force of the sandpaper bands 10 exerted by rotation of the wheel 1 and an abrasion finishing or shaping force exerted by rotation of the sandpaper bands 10 result. The combination of these forces causes an abrasion effect similar to that obtained by the use of a belt sander with greater versatility than that obtained by the use of a conventional flap wheel.

In the foregoing embodiments, wire brushes are used as the flexible, plate-like members. The plate-like member is, however, not limited to a wire brush. Any member may be used as a plate-like member as long as it suitably supports the sandpaper band.

Various modifications of the foregoing embodiments will become apparent to one of ordinary skill in the art. Any such modifications that basically rely on the teachings through which the invention has advanced the art are properly considered within the spirit and scope of the invention.

We claim:

1. An apparatus for abrading a surface, comprising:

rotary wheel means arranged to be driven for rotation about a first axis;

a plurality of flexible brush members extending radially outwardly from said first axis, said flexible members supported by and spaced about the periphery of said rotary wheel means;

an endless abrasive band slidably wound around each brush member;

holder pin means for retaining said abrasive bands associated with each said abrasive band and attached to said rotary wheel means to extend parallel with said first axis;

each said abrasive band being slidably wound around a single associated holder pin means;

each said abrasive band arranged to freely slide over both its respective flexible member and its respective holder pin means;

reinforcement means for reinforcing said flexible brush members over a portion of the inner radial length of the brush members;

said reinforcement means including integral means comprising a singular bent sheet-like member wrapped over the radially inner ends of and supporting said flexible brush members about the periphery of said rotary wheel means;

said rotary wheel means comprising radially extending, axially opposed parallel plate means including openings for receiving said reinforcement means;

said reinforcement means extending axially between said plate means and connected to the rotary wheel means solely by engagement between the ends of the reinforcement means and the openings in said plate means, said reinforcement member ends being retained by said openings in said plate means against movement in circumferential and radial directions.

2. An apparatus for abrading a surface as claimed in claim 1, wherein said flexible brush members comprise wire brushes.

3. An apparatus for abrading a surface as claimed in claim 1, wherein each abrasive band is substantially supported over its radially outer length and width by its associated flexible brush member.

4. An apparatus for abrading a surface, comprising:

rotary wheel means arranged to be driven for rotation about a first axis;

a plurality of flexible brush members extending radially outwardly from said first axis, said flexible members supported by and spaced about the periphery of said rotary wheel means;

an endless abrasive band slidably wound around each brush member;

rotatable shaft means for retaining said abrasive bands associated with each abrasive band and attached to said rotary wheel means to extend parallel with each first axis;

each said abrasive band wound over its associated rotatable shaft means and arranged to freely slide over its respective flexible brush member;

drive means for positively rotating said rotatable shaft means to effect movement of the abrasive bands along their respective lengths;

said drive means and rotary wheel means being driven by the same driving power source;

reinforcement means for reinforcing said flexible brush members over a portion of the inner radial length of the brush members;

said reinforcement means including integral means comprising a singular bent sheet-like member wrapped over the radially inner ends of and supporting said flexible brush members about the periphery of said rotary wheel means;

said rotary wheel means comprising radially extending, axially opposed parallel plate means including openings for receiving said reinforcement means;

said reinforcement means extending axially between said plate means and connected to the rotary wheel means solely by engagement between the ends of the reinforcement means and the openings in said plate means, said reinforcement member ends being retained by said openings in said plate means against movement in circumferential and radial directions.

5. An apparatus for abrading a surface as claimed in claim 4, wherein the drive means is arranged to drive the abrasive bands in the same direction as the direction of rotation of the rotary wheel means.

6. Apparatus as claimed in claim 1, said wheel means comprising a central arbor shaft; said radially extending, axially opposed parallel plate means affixed to the arbor shaft by a removable fastener; said flexible brush members and holder pin means located between said opposed plate means.

7. Apparatus as claimed in claim 1, said bent sheet-like member including a radially extending straight wall section extending along the side of a brush member; a curved radially inner wall section for receiving the radially inner ends of a brush member, and a circumferentially extending tab portion opposite said straight wall section.

* * * * *